United States Patent [19]

Cornell et al.

[11] 4,453,660

[45] Jun. 12, 1984

[54] FORMS FEED TRACTOR

[75] Inventors: Robert W. Cornell, Boca Raton; Donald K. Rex, Highland Beach, both of Fla.

[73] Assignee: International Business Machines Corporation, Armonk, N.Y.

[21] Appl. No.: 199,891

[22] Filed: Oct. 23, 1980

[51] Int. Cl.[3] ..... B65H 17/38

[52] U.S. Cl. ..... 226/74; 226/87

[58] Field of Search ..... 226/74, 75, 87, 170, 226/171, 172

[56] References Cited

U.S. PATENT DOCUMENTS

| | | | |
|---|---|---|---|
| 3,113,823 | 12/1963 | Phillips | 226/75 X |
| 3,392,893 | 7/1968 | Bennett et al. | 226/74 |
| 3,507,431 | 4/1970 | Hepp et al. | 226/74 |
| 3,521,500 | 7/1970 | Goudin et al. | 226/74 |
| 3,606,122 | 9/1971 | Brewster et al. | 226/74 |
| 3,608,801 | 9/1971 | Nystrand | 226/74 |
| 3,688,959 | 9/1972 | Staneck et al. | 226/75 |
| 3,825,162 | 7/1974 | Hubbard | 226/74 |
| 3,938,721 | 2/1976 | Staneck et al. | 226/75 |
| 3,960,304 | 6/1976 | Holland-Letz | 226/74 |
| 4,129,239 | 12/1978 | Hubbard | 226/75 |

*Primary Examiner*—Stanley N. Gilreath

*Attorney, Agent, or Firm*—Harry W. Barron; John C. Black; J. Jancin, Jr.

[57] ABSTRACT

There is disclosed herein a forms feed tractor mechanism having a belt with pins and driving elements extending threrethrough. The pins are adapted to engage perforated holes along the edge of a recorded medium. Driver means are provided for rotating the belt and pins and thereby rotate the engaged medium. Also, there is provided a spring tensioner for maintaining tension on the belt. The tractor includes a door which is rotatably snapped fitted into the housing of the tractor and maintained above the plane of the record medium by an extension on the lower surface thereof. The belt and pins are constructed by molding the pins around the belt side so that the belt is below the feeding surface of the tractor mechanism upon which the paper rests.

14 Claims, 15 Drawing Figures

FIG. 6A
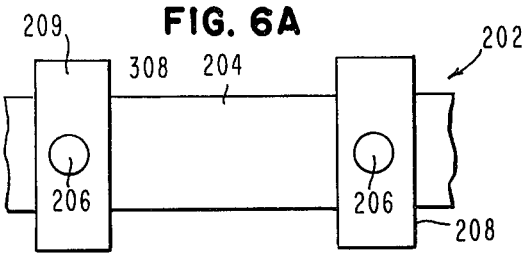
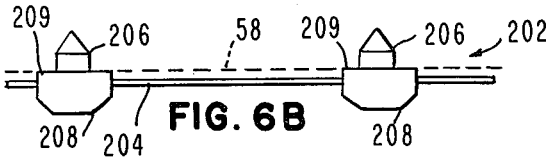
FIG. 6B
FIG. 6C
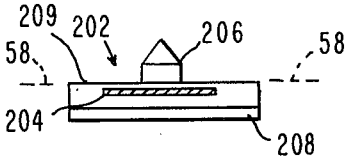
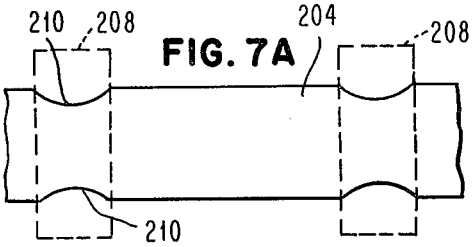
FIG. 7A
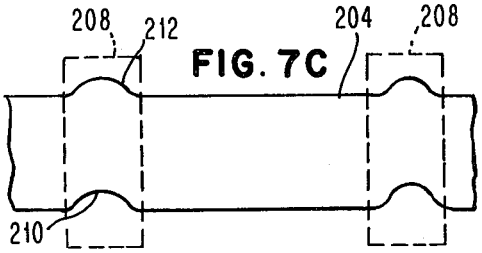
FIG. 7C
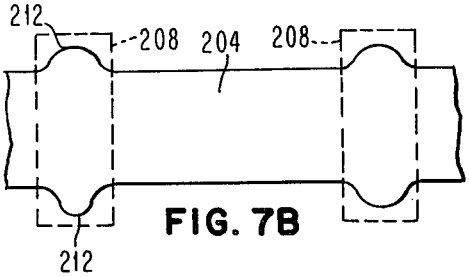
FIG. 7B
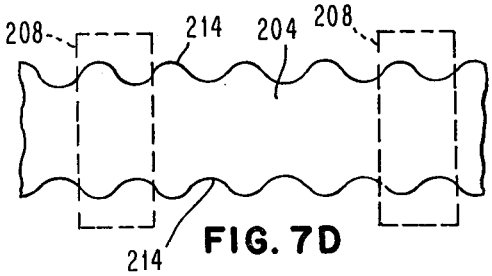
FIG. 7D
FIG. 8A
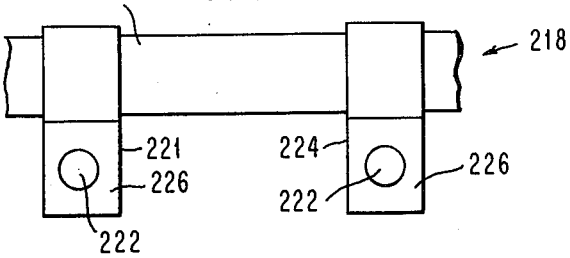
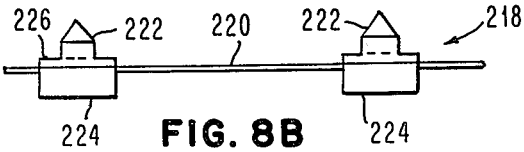
FIG. 8B
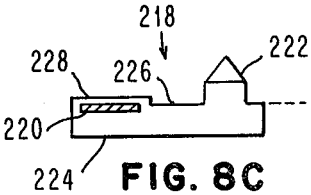
FIG. 8C

FORMS FEED TRACTOR

This invention relates to a forms feed tractor and, more particularly, to a forms feed tractor for moving a record medium, such as paper having edge perforations, through a printer or other similar apparatus operating upon the record medium.

Forms feed tractor mechanisms have been used for many years for moving paper through printers and the like. The paper utilized is conventional computer paper having pre-punched holes along both sides. A pair of tractor mechanisms are mounted at an appropriate place on the forms handling portion of the printer and pins within the tractor mechanism are inserted into the pre-punched holes on the paper. As the pins are moved, they carry the paper forward through the printer. Generally the tractor pins are arranged in an endless loop manner and means are provided within the tractor for rotating the endless loop, thereby causing the pins to move. Typically the pins may be mounted as portions of links adapted to be connected into a chain configuration or may be positioned in holes of a thin plastic or metal belt.

Typical prior art tractor mechanisms are shown by U.S. Pat. No. 3,825,162 to Hubbard, granted Jul. 23, 1974, U.S. Pat. No. 3,688,959 to Staneck, granted Sept. 5, 1972, U.S. Pat. No. 3,608,801 to Nystrand, granted Sept. 28, 1971, U.S. Pat. No. 3,507,431 to Hepp et al, granted Apr. 21, 1970, U.S. Pat. No. 3,392,893 to Bennett et al, granted Jul. 16, 1968 and U.S. Pat. No. 3,113,823 to Phillips, granted Dec. 10, 1963 and U.S. Pat. No. 4,226,353 to S. U. Bloskovic et al, granted Oct. 7, 1980 and assigned to the assignee hereof.

In these tractor mechanisms, the tractor pins are inserted into holes in an endless loop belt and as the belt rotates around the tractor frame, the belt forms the surface upon which the paper rests. Typically, the construction of the pins is such that a pin extends upward from the top surface of the belt and is of a physical dimension to be inserted into the holes of the paper. In addition, a driving element extends from the opposite surface of the belt and rides in a channel around the tractor. At one end of the tractor, a sprocket wheel is positioned to engage the lower driving element portion and as the sprocket wheel is rotated, it causes the belt to rotate.

A significant problem exists in the belt construction of the prior art in that a space may exist at the junction of the belt and the pin element. The paper can become jammed in this space, and as the paper is moved forward away from engagement with the pins, a rip in the paper will occur. This problem is particularly acute in those type of tractor belt mechanisms in which pins are physically pushed through pre-punched holes in the belt, whereby a loose fit exists between the bottom of the pin and the belt. It should be noted that the bottom of the pin portion must be at least slightly larger than the pre-punched hole in order to prevent the pin from falling out. The problem also potentially exists even in those type tractor belts in which the pins are molded through pre-punched holes because of the different material of the pin and the belt prevents an actual fusion occurring beneath the upper portion of the belt and the pin. A second problem, which exists where the paper rides on the bottom surface, is that the belt can become worn due to its contact with the paper.

In order to overcome the above problems, there is provided, in accordance with one aspect of this invention, a tractor mechanism for moving a record medium having edge perforations therein comprising frame means having a supporting surface which supports the record medium and a channel through the supporting surface. In addition, there is provided a thin strip having irregularities along at least one side thereof and the plurality of drive members affixed to the strip. Each of the drive members has an upper pin portion sized to engage in the holes in the medium and a lower drive element portion sized to freely move along the channel with a minimum of movement across the channel. The drive element portion has an upper flat surface and is sized so that the upper flat surface is substantially in the same plane as the supporting surface when the bottom of the drive element portion rests on the bottom of the channel. The upper pin portion extends upward from the upper flat surface. The drive members are affixed to the strip at an irregularity and within the drive element portion at a position near the upper flat surface, and at intervals separated so that the upper pin portions engage the record medium perforations.

With this type of a structure, the frame of the tractor mechanism provides the surface upon which the paper rides and the belt is positioned below the riding surface and within the channel so that the paper never physically comes in contact with the belt. With this arrangement, the paper cannot become trapped between the pin portion and the belt no belt wear occurs due to the paper riding on the strip.

A detailed description of one preferred embodiment of the present invention will hereafter be given with specific reference being made to the following figures in which:

FIGS. 6A, 6B and 6C show respectively a top, side and front view of a pin and belt construction according to this invention;

FIGS. 7A, 7B, 7C and 7D show four different belts useful in the construction of FIGS. 7A, 7B and 7C; and FIGS. 8A, 8B and 8C show respectively a top, side and front view of a second pin and belt construction according to this invention.

Figure 1:
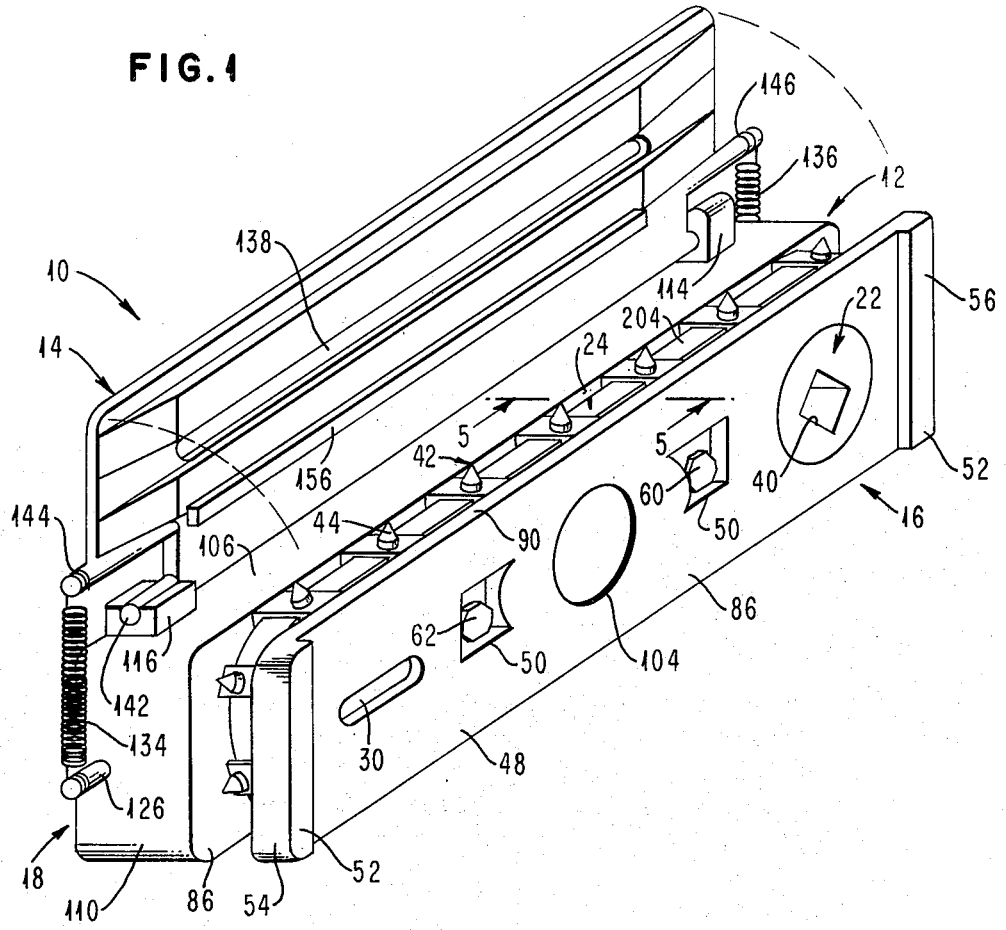
FIG. 1 shows an isometric view of the forms feed tractor mechanism.

Referring now to the FIGS. 1–5, forms feed tractor mechanism 10 will be described. Tractor 10 consists of two basic portions housing 12 and door 14. Housing 12, in turn, has inner section 16 and outer section 18. Between and contained by inner section 16 and outer section 18 is a spring loaded tension assembly 20, a sprocket 22, and an endless drive belt 24. Drive belt 24 rides in a channel formed when inner section 16 and outer section 18 are mated together. Tensioner 20 is shaped similar to the letter D having a flat portion 32 on the top and bottom and a semicircular portion on one side, and the other side being vertical and having an indentation (not shown) into which spring 26 may be inserted. Tensioner 20 also has a pair of extensions 28, one of which is shown, adapted to fit in hole 30 in inner section 16 and a corresponding hole in outer section 18. As shown, hole 30 may be ovally shaped to provide the proper vertical alignment for tensioner 20. Hole 30 should be slightly longer than extension 28 so that extension 28 can slide horizontally under spring pressure in hole 30, to apply tension to drive belt 24.

Sprocket 22 is circular shaped and includes a plurality of indentations 34 on the periphery thereof. Sprocket 22 also includes a circular lip 36 on each side thereof adapted to fit in the holes 38 in inner section 16 and outer section 18 to be maintained thereby free to rotate. Sprocket 22 also includes a square hole in its center adapted to receive a corresponding shaped rod which may be driven by a stepping motor, for instance, to cause rotation of sprocket 22.

Endless drive belt 24 includes a strip 204 of non-stretchable polyimide film, such as Kapton, to which drive members 42 are affixed in the manner shown in FIGS. 7A, 7B and 7C. Drive members 42 includes an outward extending pin 44 having a cylindrical shaped bottom portion and conical shaped top portion. Below pin 44, inward extending driving elements 46 are positioned directly opposite to the pins 44. The spacing between the drive member 42 and the shape of the driving elements 46 is selected to the same as the spacing and shape of the indentations 34 in sprocket 22 so that sprocket 22, when rotated, rotates drive belt 24. The shape of the pin 44 on drive belt 24 is selected so that the diameter of the cylindrical portion of the pin 44 is slightly less than the holes in the record medium being moved and of a spacing equivalent to the distance between the holes in the record medium.

As drive belt 24 is rotated by sprocket 22, the pins 44 are inserted into the holes of the record medium as each pin 44 moves upward over the curved portion of tensioner 20.

Inner section 16 of housing 12 has outside surface 48 having a pair of indentations 50 therein. Also, a pair of lips 52 extend from surface 48 at the junction of the front 54 and back 56 of inner section 16. The lips serve to provide a wider surface for receiving the record medium as it enters and leaves the tractor mechanism 10.

Inner section 16 has on its inside surface 88 an extension or extended portion 58 adapted to have the vertical portion 32 of tensioner 20 applied there against on one end and sprocket 22 applied adjacent thereto on the other end. Extended portion 58 is designed to mate against outer section 18 and to be secured together by bolts 60 and 62 inserted through holes 64 and 66 into a self-threading hole 68 in outer section 18. It should be noted that holes 64 and 66 are within indentation 50 on the inside surface 48 of inner section 16. On the extended portion 58 surrounding each of hole 64 and 66, is circular extended portions 70 and 72 designed to fit into corresponding indentations 74 in outer section 18. Extended portion 58 also includes an indentation 76 adapted to receive the other end of spring 26 when tensioner 20 is positioned against inner section 16.

The top 78 of extended portion 58 of inner section 16 is below the top surface 40 of inner section 16 which when secured to outer section 18 forms a channel upon which driving elements 46 rest as drive belt 24 is rotated. Walls 80 form the sides of the channel and one of a thickness equal to the thickness of driving element 46. The size of side 32 of tensioner 20 is selected so that the channel continues around tensioner 20 when tensioner 20 is positioned against inner section 16. The bottom of inner section 16 is identical to the top thereof.

The top 78 of extended portion 58 is parallel to the top 90 of inner section 16 for the initial approximately three fourths thereof in the direction of travel of drive belt 24. However, as the pins 44 on drive belt 24 approach sprocket 22, they travel over a downard sloping ramp 82 which slopes down at approximately a 2 degree angle. The purpose of ramp 82 is to allow the pins to be essentially vertically removed from the holes in the paper prior to being roated by sprocket 22. A similar ramp 84 at a 10 degree slope is provided on tensioner 20 to allow the pins 44 to be inserted in a near vertical fashion into the holes in the paper. The purpose of both ramps 82 and 84 is to prevent pins 44 from damaging the holes in the record medium being moved by tractor 10.

Referring now to outer section 18, the inside surface 86 of outer surface 18 is adapted to receive the inside surface of extended position 58 of inner section 16. When coupled together, the upper portion of surface 86 forms the other side of the channel.

The outside surface 94 of outer section 18 includes four threaded holes 96 for securing clamp 98 to outer section 18 by two bolts 100 applied through corresponding holes in clamp 98. Clamp 98 also includes a knob 102 for securing tractor 10 to a rod (not shown) inserted through the center of clamp 98 and hole 104 in inner section 16. It should be noted that bolts 100 are secured to the top two holes of clamp 98 allowing the bottom portion of clamp 98 to remain free to be drawn towards the top portion by turning knob 102. The provisions of four holes in clamp 98 and four holes 96 in outer section 18 is for the purpose of being able to turn clamp 98 180 degrees so that the parts and assembly of a left hand tractor mechanism 10 shown in FIG. 2 can be used as a right hand tractor mechanism by merely turning clamp 98 180 degrees and inserting door 14 on the other side of section 18.

The top 106 and bottom 108 of outer section 18 are identical as are the front 110 and back 112.

Top 106 of outer section 18 includes a permanent door receiver 114 and a snap-in door receiver 116. Permanent door receiver 114 includes a closed hole 118, the bottom of which is positioned a given distance above the top 106 of section 18. Snap-in door receiver 116 is similar to receiver 114 except that the upper portion of the hole has been removed leaving an open hole 120 into which a cylindrical post may be snapped fitted. On the bottom 108 of section 18, receivers 122 and 124 are positioned in exactly the same manner as receivers 114 and 116 and serve the same function for a right handed tractor as receivers 114 and 116 serve for the left handed tractor shown, the difference being into which pair of receivers 114, 116 or 122, 124 that door 14 is inserted.

The front 110 and back 112 of section 18 includes posts 126 and 128 extending from the vertical center of front 110 and back 112 and in alignment with receivers 114 and 116. Each of posts 126 and 128 have an indentation 130, 132 therein near the outer edge to which one end of respective springs 134 and 136 are attached.

Referring now to door 14, it is generally of the same size as the top of sections 16 and 18 when secured together to form a housing of tractor 10. Door 14 includes a slot 138 from the top to the bottom thereof which when door 14 is positioned into receivers 114 and 116 is in alignment with pins 42.

Door 14 also includes a pair of posts 140 and 142. Post 140 is adapted to be inserted into hole 118 in receiver 114 and post 142 is adapted to being thereafter snap-fitted into receiver 116. Connected in such a manner, door 14 is free to rotate about the axis through hole 118 and partial hole 120. Door 14 also has a second pair of posts 144 and 146 similar to posts 126 and 128 on section 18.

Posts 144 and 146 also include indentations 148 and 150 to which the other end of springs 134 and 136 are attached when door 14 is inserted in receivers 114 and 116. Door 14 also includes slots 152 and 154 positioned so that when door 14 is rotated into the open position, clamp knob 102 will rest against the bottom of slot 154 in the left hand tractor version shown or against the bottom of slot 152 in the alternate right hand tractor version when door 14 is inserted into receivers 122 and 124 and clamp 98 is rotated 180 degrees from that shown. With slots 152 and 154 present, door 14 when rotated into the open position will have rotated slightly past the vertical so that springs 134 and 136 will maintain door 14 firmly against knob 102, thereby maintaining door 14 open.

Figure 5:
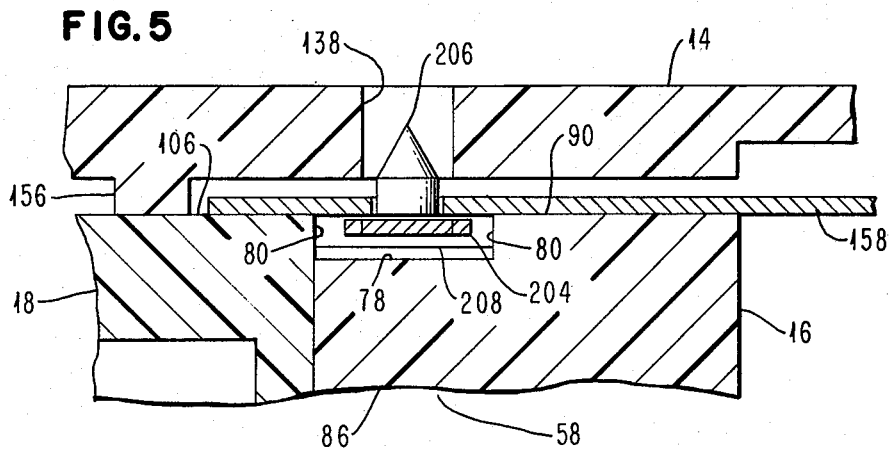
FIG. 5 shows a view taken across lines 5—5 of FIG. 1 with the door in the closed position, and the record medium inserted.
Figure 2:
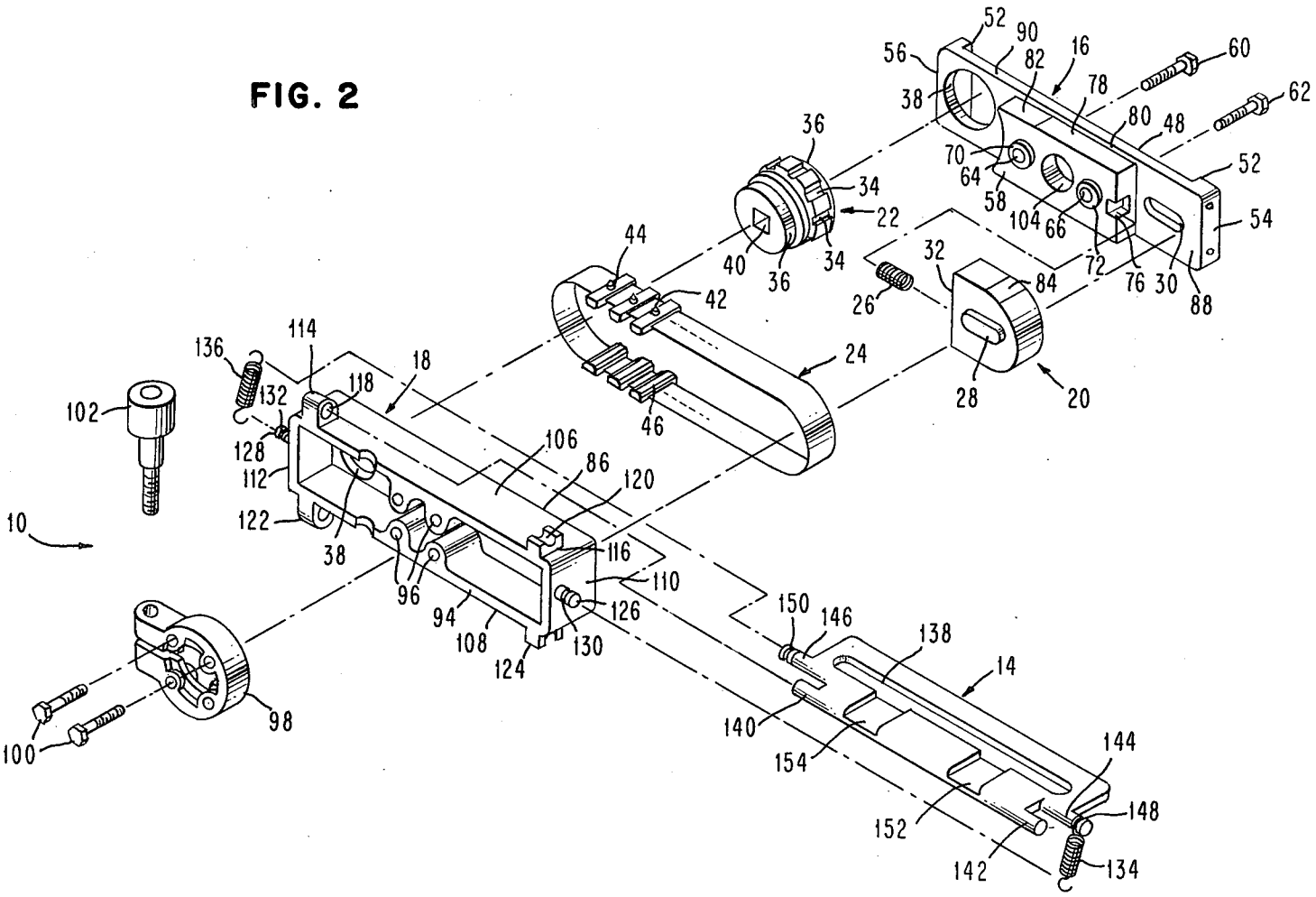
FIG. 2 shows an exploded view of the various parts of the forms feed tractor mechanism shown in FIG. 1.
Figure 3:
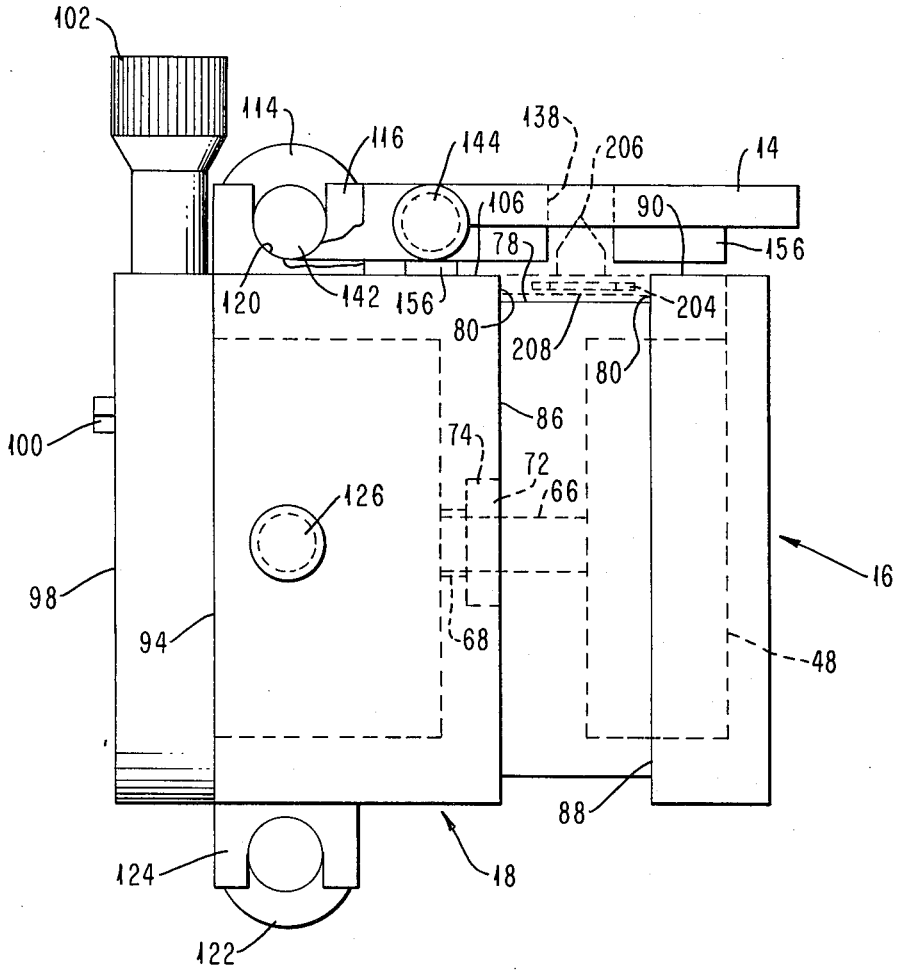
FIG. 3 shows an end view of the tractor mechanism shown in FIG. 1.
Figure 4:
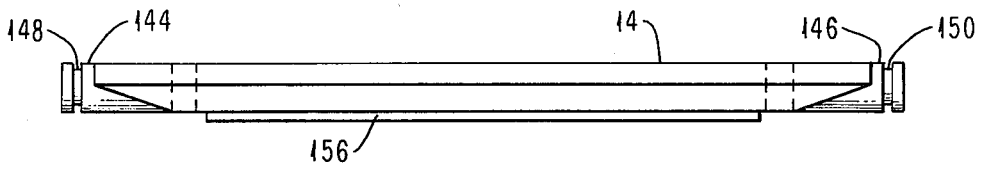
FIG. 4 shows a side view of the door shown in FIG. 1.

When door 14 is in a closed position, it is necessary that spring 134 and 136 not cause the bottom of door 14 to contact the top surface of inner section 16 or outer section 18 over which the record medium passes. On the bottom side of door 14, extension 156 is provided and extends from the bottom surface of door 14 a distance approximately equal to the distance the bottom of holes 118 and 120 are above the top surface of section 18. Thus, when door 14 is rotated into the down position, as shown in FIGS. 3 and 5, the entire bottom surface thereof is maintained parallel to the top 78 a distance equivalent to the extension 156 distance. Extension 156 must be positioned away from the area in which the record medium is positioned on the one hand, and on the other hand, as far away from posts 140 and 142 as possible to lessen the leverage effect of tolerance buildup at the paper gap. FIGS. 3 and 5 best show the manner in which extension 156 and pins 140 and 142 maintain door 14 above the upper surfaces of sections 16 and 18. FIG. 5, in particular, shows in cut-away views the manner in which the record medium 158 travels over top 78 with respect to the positioning of extension 156.

As previously mentioned, prior art drive belts 24 included a thin plastic strip having a width slightly wider than the channel formed by walls 80 and surface 78 as shown in FIGS. 3 and 5. The prior art belt was manufactured by punching holes in the center of strip 204 at spaced intervals equal to the intervals of the holes in the pre-punched paper. The punched strip 204 with the holes aligned with the mold is then inserted in a mold and plastic material forming pin 44 and drive element 46 is inserted into the mold. The plastic material flows through the pre-punched hole and forms unitary structure pin 44 and drive element 46. The fabrication technique is such that pins 44 and drive element 46 are inserted in each of the holes of the strip 204, except for the first and last hole. The last step in the manufacturing process is to overlap the first hole and the last hole with one another and mold a single pin 44 and drive element 46 structure in the overlapped holes, thereby forming a closed loop tractor belt. Specific reference is made to U.S. Pat. No. 3,825,162 to Hubbard for a more complete description of this prior art technique of fabricating belt 24.

The physical size of the prior art drive element 46 is such that the distance from the bottom of strip 204 to the bottom of drive element 46 is no greater than the height of wall 80, shown in FIGS. 3 and 5, and the width of drive element 46 is slightly less than the width of surface 78, whereby the belt 24 is vertically supported through the channel by drive element 46 resting on the bottom of the channel or the strip 204 resting on surfaces 90 and 106.

Two problems exist with the prior art drive belt discussed above. First, the fact that strip 104 is above surfaces 90 and 106 causes the record medium to rest on strip 104 and further causes strip 204 to contact surfaces 90 and 106, thereby causing additional wear thereto. The second problem is that the junction between pin 44 and strip 204 may become loose and allow the record medium to be trapped therebetween. If this occurs, the record medium will tear, thereby causing a form feed jam.

Both of the problems with respect to the prior art belt construction are overcome by constructing a belt as shown in FIGS. 6A, 6B and 6C, which respectively represent a top, side and front view of an improved belt structure 202. Belt structure 202 includes a thin strip 204 which may be of the same material as used in the prior art such as a polyimide film made by E. I. duPont Company of Wilmington, Del. and sold under the trade name of Kapton. This material is particularly suited for use in strip 204 because of its high flex life, low moisture absorption and low creep property allowing dimensional stability, low elastic modulus allowing good flexibility and high tensile strength allowing a long life. In addition, the polyimide film has a service temperature up to 400 degrees C. which allows the pin and drive elements to be injection molded thereon. The pin 206 and drive element 208 shown in FIGS. 6A, 6B and 6C are positioned laterally along strip 204 in the same special relationship in the prior art. However, strip 204 is narrower than the width of drive element 208 and coupled to drive element 208 totally within drive element 208, whereby, when strip 204 is used in the tractor mechanism, it will ride below the top of the channel, as shown in dotted lines in FIG. 3 and in solid lines on FIG. 5. The size of drive elements 208 is such that their height within the channel is equal to the height of wall 80, whereby the top 209 of drive element 208 is in the same plane as surfaces 90 and 106. Thus, the record medium 58, shown as a dashed line in FIGS. 6B and 6C, rests on the top 209 of drive element 208. Now, however, since no space exists between pin 206 and drive element 208, the record medium 58 cannot become caught as was the case on the prior art.

Referring to FIGS. 7A, 7B, 7C and 7D, four different configurations of strip 204 are shown. Common for all of these configurations is that they allow drive element 206 to be molded around strip 204 rather than through a hole therein. In each of FIGS. 7A, 7B, 7C and 7D, drive element 208 has been shown as dashed lines, it being understood that strip 204 is positioned totally within drive element 208. Also common for each of the configurations in FIGS. 7A, 7B, 7C and 7D is an irregularity along the edges of strip 204. In FIGS. 7A, strip 204 has notches 210 taken out of each side at a distance equal to the spacing of the holes of the record medium. In FIG. 7B, extensions, 212 are extended from the side of strip 204. Extension 212 must be of such a size as to remain wholly within drive element 208 and still allow an area for the molded plastic material to move from one side of the mold to the other side of the mold. FIGS. 7C shows a combination of 7A and 7B in that notches 210 are used on one side of the belt and extensions 212 are used on the other side. This configuration allows a series of belts to be cut from a sheet of polyimide film material without any material wastage. Finally, FIG. 7D shows a belt 204 having scalloped edges 214, around which drive element 208 is molded.

The purpose of the irregularities, whether notches 210, extensions 212, or the scalloped edge 214, is to prevent any slippage of drive elements 208 after long and continued usage. Even if drive element 208 becomes loose from belt 204, the irregularity on the side of belt 204 will prevent any lateral slippage of drive element 208.

The placement of strip 204 within drive element 208 should be such that strip 204 is as close to surface 209 as possible to minimize any exit or entry interference due to separation between pin 206 and the rotation path defined by strip 204.

Referring now to FIGS. 8A, 8B and 8C, an alternate embodiment of the drive belt construction is shown and identified by the reference number 218. In this embodiment, strip 220 is narrower than in the previous embodiment and the pin 222 and drive element 224 construction is different. In this case, pin 222 is positioned at an end of drive element 224 and on a plateau 226 slightly below the top surface 228 of drive element 224. Above strip 220 is then positioned on the other half of drive element 224 as shown in FIG. 9C. The edge of the paper (not shown) rests against the wall separating plateau 226 from surface 228 above strip 220. This embodiment has the advantage that the rotation path defined by strip 220 is in the same plane as the bottom of pin 222.

We claim:

1. A tractor mechanism for moving a record medium having edge perforations therein comprising:

frame means having a supporting surface which supports said record medium and a channel through said supporting surface;

a thin strip having irregularities along at least one side thereof; and a plurality of drive members affixed to said strip, each drive member having an upper pin portion size to engage the holes in said medium and a lower drive element portion sized to freely move along said channel with a minimum movement across said channel, said drive element portion having an upper flat surface and being sized so that said upper flat surface is substantially in the same plane as said supporting surface when the bottom of said drive element portion rests on the bottom of said channel, said pin portion extending upward from said upper flat surface, said drive members being affixed to said strip at an irregularity within said drive element portion at a position below said upper flat surface and at intervals separated so that said pin portions engage said record medium perforations.

2. The invention according to claim 1 wherein said strip and drive members are arranged in a closed loop.

3. The invention according to claim 2 wherein said drive members are affixed to said strip within said drive element portions near said upper flat surface.

4. The invention according to claim 3 wherein said irregularities included an indention along at least one side of said strip.

5. The invention according to claim 3 wherein said irregularities includes indentions along both sides of said strip.

6. The invention according to claim 3 wherein said irregularities includes extensions along at least one side of said strip.

7. The invention according to claim 3 wherein said irregularities includes extensions along both sides of said strip.

8. The invention according to claim 3 wherein said drive members are affixed to said strip by being injection molded around said strip at an irregularity.

9. The invention according to claim 1 wherein said drive members are affixed to said strip by being injection molded around said strip at an irregularity.

10. The invention according to claim 9 wherein said irregularities include indentions along at least one side of said strip.

11. The invention according to claim 9 wherein said irregularities include extensions along at least one side of said strip.

12. In a feeding mechanism for feeding a record medium through apparatus which operates upon said record medium, said record medium having prepunched holes along the sides thereof, which are spaced apart by a predefined distance, said feeding mechanism including a frame assembly having a feeding surface and a channel through said feeding surface, said channel having a certain width and depth, the improvement of a belt assembly comprising a thin flexible strip having a plurality of irregularities being spaced apart by an amount related to said predefined distance; a plurality of molded drive members having a driving element portion and a pin portion, said driving element portion having a width slightly less than said channel certain width and a height equal to said channel certain depth, said pin portion extending upward from an upper surface of said driving element portion and sized to engage said record medium, said drive members being affixed to said belt by being injection molded around a belt irregularity such that a belt irregularity is wholly within said driving element portion of each drive member, at least one drive member having the first and last irregularities overlapped within a driving element portion, whereby said belt assembly is an endless loop, said driving element portions of said endless loop being guided in said channel with said strip being positioned within said channel below said feeding surface, and said upper surface of said driving element portions being in the same plane as said feeding surface.

13. The invention according to claim 12 wherein said irregularities include indentions along at least one side of said strip.

14. The invention according to claim 12 wherein said irregularities include extensions long at least one side of said strip.

* * * * *